US007385555B2

(12) United States Patent
Mahmoud et al.

(10) Patent No.: US 7,385,555 B2
(45) Date of Patent: Jun. 10, 2008

(54) SYSTEM FOR CO-PLANAR DUAL-BAND MICRO-STRIP PATCH ANTENNA

(75) Inventors: Mohamed S. Mahmoud, Sunnyvale, CA (US); Edward N. Rosario, Methuen, MA (US); Basrur R. Rao, Lexington, MA (US)

(73) Assignee: The Mitre Corporation, McLean, VA (US)

( * ) Notice: Subject to any disclaimer, the term of this patent is extended or adjusted under 35 U.S.C. 154(b) by 0 days.

(21) Appl. No.: 10/986,078

(22) Filed: Nov. 12, 2004

(65) Prior Publication Data

US 2006/0103576 A1 May 18, 2006

(51) Int. Cl.
*H01Q 1/38* (2006.01)

(52) U.S. Cl. ..... 343/700 MS; 343/705

(58) Field of Classification Search ..... 343/700 MS, 343/846, 848, 705, 708
See application file for complete search history.

(56) References Cited

U.S. PATENT DOCUMENTS 3,622,890 A 11/1971 Fujimoto et al.
4,821,040 A * 4/1989 Johnson et al. ..... 343/700 MS
5,138,651 A 8/1992 Sudo
5,349,361 A 9/1994 Egashira et al.
5,745,079 A * 4/1998 Wang et al. ..... 343/700 MS
6,061,025 A * 5/2000 Jackson et al. ..... 343/700 MS
6,184,828 B1 * 2/2001 Shoki ..... 342/372
6,323,821 B1 11/2001 McLean
6,483,463 B2 11/2002 Kadambi et al.
6,720,935 B2 4/2004 Lamensdorf et al.
6,734,828 B2 5/2004 Shor
6,788,257 B2 * 9/2004 Fang et al. ..... 343/700 MS
6,788,264 B2 * 9/2004 Du ..... 343/725
6,856,287 B2 2/2005 Rao et al.
7,209,080 B2 * 4/2007 Crouch et al. ..... 343/700 MS

* cited by examiner

*Primary Examiner*—HoangAnh T Le
(74) *Attorney, Agent, or Firm*—Sterne, Kessler, Goldstein & Fox PLLC

(57) ABSTRACT

An antenna assembly includes a conducting ground plane, a single dielectric substrate layer or a plurality of dielectric substrate layers each with different dielectric constants mounted to the conducting ground plane. A central patch element is mounted to the dielectric substrate layer or layers and configured to radiate within a first frequency band. A plurality of probes (i) extend through the conducting ground plane and the dielectric substrate and (ii) are physically connected to the central patch element. A parasitic ring is disposed around the central patch element and reactively coupled thereto. The parasitic ring is configured to radiate within a second frequency band.

18 Claims, 6 Drawing Sheets

SYSTEM FOR CO-PLANAR DUAL-BAND MICRO-STRIP PATCH ANTENNA

STATEMENT REGARDING FEDERALLY-SPONSORED RESEARCH AND DEVELOPMENT

Part of the work performed during development of this invention utilized U.S. Government funds. The U.S. Government has certain rights in this invention.

BACKGROUND OF THE INVENTION

1. Field of the Invention

The present invention generally relates to microstrip patch antennas. More particularly, the present invention relates to deriving dual-band performance from micro-strip patch antennas.

2. Related Art

Micro-strip patch antennas are popular because of their compact size, light weight, and low cost to fabricate. Their low profile and their ability to conform to the shape of an aircraft fuselage make these microstrip antennas particularly attractive for airborne satellite communications and navigation systems. Additionally, micro-strip patch antennas can easily be constructed using printed circuit technology. However, a major limitation is their relatively narrow bandwidth capability.

Many patch antenna applications, such as navigational, vehicular, wireless communication systems, and radar systems, require dual-band, or wideband, operation. The narrow bandwidth capability of conventional micro-strip antennas, however, limits their use in these applications. Since patch antennas are so desirable, however, significant research and development has been devoted to adapting these antennas to dual-band operation.

A common technique to obtain dual-band operation from a conventional micro-strip antenna is known as stacking. Stacking entails simply piling micro-strip antennas or radiators, each operating at different frequencies, on top of each other. Stacking conserves space in a transverse or lateral direction. In a stacked patch design, the second frequency is achieved by the lower patch radiator. This lower patch is larger in size compared to the upper patch and is tuned to the lower of the two desired frequencies. Unfortunately, however, the performance of the lower patch is degraded by blockage from the upper patch and by any other patches in close proximity thereto. And the gain and beam width of the bottom patch antenna radiator is often degraded by stacking.

Stacking also increases the vertical height of the antenna, making it unattractive for low-profile and conformal applications. An additional complication of stacking is the need for bonding the top and bottom patch antennas together with glue or some other bonding agent. This bonding further increases the overall cost and complexity of building the antenna.

A second technique used to derive dual-band performance from a conventional micro-strip patch is to provide slots in the antenna. Although a variety of slotted micro-strip antennas have been designed, most are limited by their polarization characteristics, bandwidth, and/or gain. For example, most slotted dual-band patch antennas are either linearly polarized or have poor circular polarization performance at the desired dual frequency bands.

An exemplary environment in which micro-strip antennas can operate is that of satellite communications and satellite navigation. In satellite communications, for example, circular polarization is preferred over other types of polarization. Circular polarization, among other things, factors into account the movement of the satellite with respect to the Earth. Circular polarization also takes into account other anomalies, such as Faraday rotation and depolarization caused by precipitation particles such as rain and ice in the atmosphere.

Global positioning system (GPS) satellites, used in navigation for example, require circular polarization. In fact, optimizing the performance of GPS requires not only circular polarization, but requires that the corresponding circular polarization electromagnetic components, be relatively pure. Also, slots that are traditionally used to provide dual-band operation from conventional micro-strip antennas are generally designed as narrow-band filters.

GPS and other satellite communication systems, however, require much wider bandwidths for optimal performance. In fact current military GPS navigation systems require GPS antennas to operate in two separate frequency bands centered at 1575 and 1227 MHz in order to provide better precision accuracy in range by allowing correction for errors introduced by the ionosphere.

GPS navigation systems are also being modernized. To accommodate military M code signals, future GPS systems starting in 2005, will require at least 24 megahertz (MHz) bandwidth antennas. In addition a third frequency band called $L_5$, operating at a center frequency of 1176 MHz will also be added to the current frequency bands, $L_1$ (center frequency of 1575 MHz) and $L_2$ (center frequency of 1227 MHz).

Civilian navigation systems, including the FAA, will rely mainly on the $L_1$ and $L_5$ frequency bands whereas U.S. military systems will rely primarily on $L_1$ and $L_2$ frequency bands, both of which will have an enhanced bandwidth of 24 MHz to also accommodate the new military M Code signals.

The operating bandwidths of conventional micro-strip patch antennas are much too narrow to satisfy these future GPS multiband frequency requirements and will place an additional emphasis on the need for newer microstrip antenna designs capable of providing dual band or even triple band operation with the desired bandwidth, gain and circular polarization characteristics to meet operational needs in both civilian and military GPS navigational systems.

Additionally, the European Union will also be launching in 2005 their own version of a GPS navigation system called "Galileo". The Galileo frequencies are 1575 and 1176 MHz—which is the same as for the modernized U.S. GPS system as well as two new frequencies centered at 1207 MHz and 1279 MHz. Hence there will be strong commercial interest in developing broadband dual-band or even triple-band GPS antennas that cover all or some of both the U.S. GPS and the European Galileo navigation systems to be launched starting in 2005.

Some of the other slotted bandwidth enhancement designs restrict radio frequency (RF) current flow on the surface of the patch to narrow areas. This current restriction generally decreases the antenna gain at the second, or resonant, frequency achieved by inserting the slot. The radiation pattern at the resonant frequency is also asymmetric and distorted because of this uneven current flow. This asymmetry further decreases performance.

What is needed, therefore, is a compact and light-weight micro-strip patch antenna that is capable of operating in at least two different frequency bands. It is desirable that this dual-band patch antenna be circularly polarized and located on top of a single dielectric substrate layer or a plurality of dielectric substrate layers. It is also desirable that this patch antenna provide good gain over a large portion of the upper hemisphere to acquire signals from multiple satellites over a wide range of elevation angles.

What is also needed is a dual band co-planar antenna having a broad enough bandwidth to cover both the U.S. GPS and Galileo frequencies at 1176 and 1575 MHz as well as the additional Galileo frequency centered at 1207 MHz.

BRIEF SUMMARY OF THE INVENTION

Consistent with the principles of the present invention as embodied and broadly described herein, the present invention includes an antenna assembly capable of dual-frequency band operation. The antenna assembly includes a conducting ground plane, a dielectric substrate layer mounted above the conducting ground plane, and a central patch radiator element mounted above the dielectric substrate layer and configured to radiate within a first frequency band. A number of probes (i) extend up through the conducting ground plane and the dielectric substrate and (ii) are physically connected to the central patch element. A parasitic ring is disposed in a concentric manner around the central patch element and reactively coupled thereto. The parasitic ring is configured to radiate within a second frequency band that is lower in frequency than attributed to the centrally located circular patch.

Further embodiments, features, and advantages of the present invention, as well as the structure and operation of the various embodiments of the present invention, are described in detail below with reference to the accompanying drawings.

BRIEF DESCRIPTION OF THE DRAWINGS

The accompanying drawings, which are incorporated in and constitute part of the specification, illustrate embodiments of the invention and, together with the general description given above and the detailed description of the embodiment given below, serve to explain the principles of the present invention. In the drawings.

DETAILED DESCRIPTION OF THE INVENTION

Figure 1:
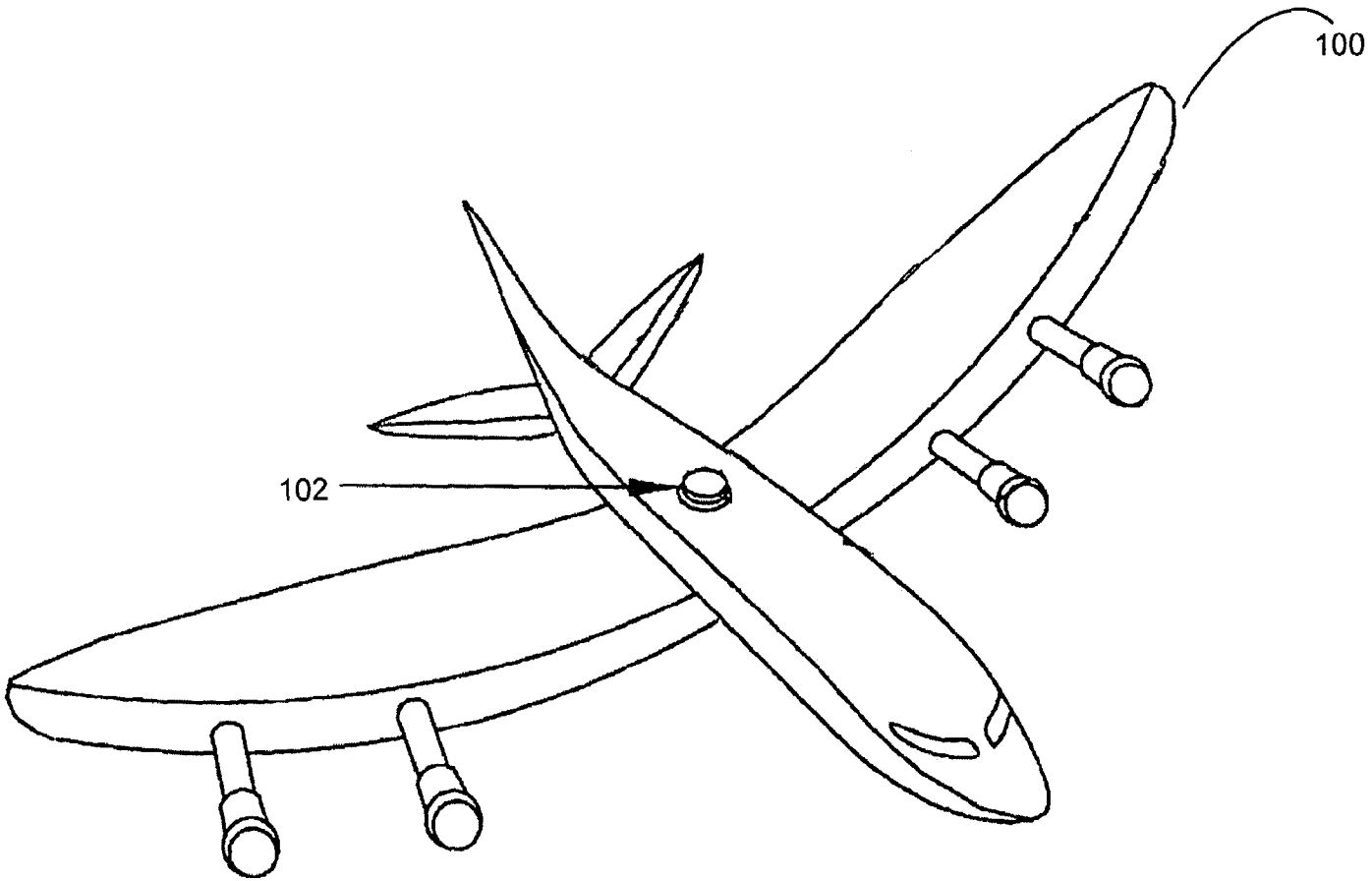
FIG. 1 is a high level illustration of an exemplary platform on which the present invention can be implemented.

The following detailed description of the present invention refers to the accompanying drawings that illustrate exemplary embodiments consistent with this invention. Other embodiments are possible, and modifications may be made to the embodiments within the spirit and scope of the invention. Therefore, the detailed description is not meant to limit the invention. Rather, the scope of the invention is defined by the appended claims.

It would be apparent to one of skill in the art that the present invention, as described below, may be implemented in many different embodiments of software, hardware, firmware, and/or the entities illustrated in the figures. Any actual software code with the specialized control of hardware to implement the present invention is not limiting of the present invention. Thus, the operational behavior of the present invention will be described with the understanding that modifications and variations of the embodiments are possible, given the level of detail presented herein.

Satellite communication and navigation technologists, in general, and the GPS community in particular, have been pushing towards more robust satellite navigation links. For example, the GPS community has been striving at increasing GPS receiver anti-jamming capabilities within real estate and cost constraints.

The ringed patch antenna technique of the present invention assists in achieving these more robust communications and satellite navigation links such as for the above mentioned GPS system. This achievement is due not only to the fact that the patch antenna is compact and inexpensive to produce, but also because it can operate in at least two GPS bands. For example, it can operate at 1.575 gigahertz (GHz) (e.g., band 1) and at 1.227 GHz (e.g., band 2). The ringed patch can replace the conventional double-layer stacked patch design currently used throughout the industry.

The ringed patch of the present invention, also offers significant performance advantages over the conventional stacked patch design, particularly at the lower frequency (band 1). In the conventional stacked patch design, as noted above, the lower frequency is achieved by the lower patch whose performance is degraded by blockage from the upper patch. The ringed patch approach of the present invention does not suffer from these limitations, as the two radiators are co-planar.

The exemplary ringed patch of the present invention does not use lumped elements or extra cost components. Instead, the present invention achieves dual-band capability by utilizing a simple parasitic passive ring radiator. This approach significantly increases production quality and reduces cost. The size of the ringed patch antenna of the present invention is also smaller than the conventional stacked patches. The small size allows extra space, for example, between elements in an antenna array within the same area.

Another potential use of the present invention is in wireless communications, where multi-band compact patches are desirable. For example, universal cellular phone handsets are highly desirable. These handsets have the capability of working in different frequency bands and operating systems in different areas. These different operating systems include time division multiplexing (TDM), global system for mobile communications (GSM), code division multiple access (CDMA) and universal mobile telecommunication system (UMTS). TDM, GSM, CDMA, UMTS, etc., are capable of operating domestically as well as internationally.

FIG. 1 is an illustration of an exemplary platform, such as an aircraft 100, upon which an embodiment of the present invention can be implemented. In FIG. 1, the aircraft 100 can represent a node of an information driven communications network. The aircraft 100 includes, for example, a phased array antenna 102 configured for directing multiple beams at different targets simultaneously. The aircraft 100 and the antenna 102 can be used for communications or navigation, for example, with a GPS satellite navigation system or with other satellite based communications network.

Figure 2:
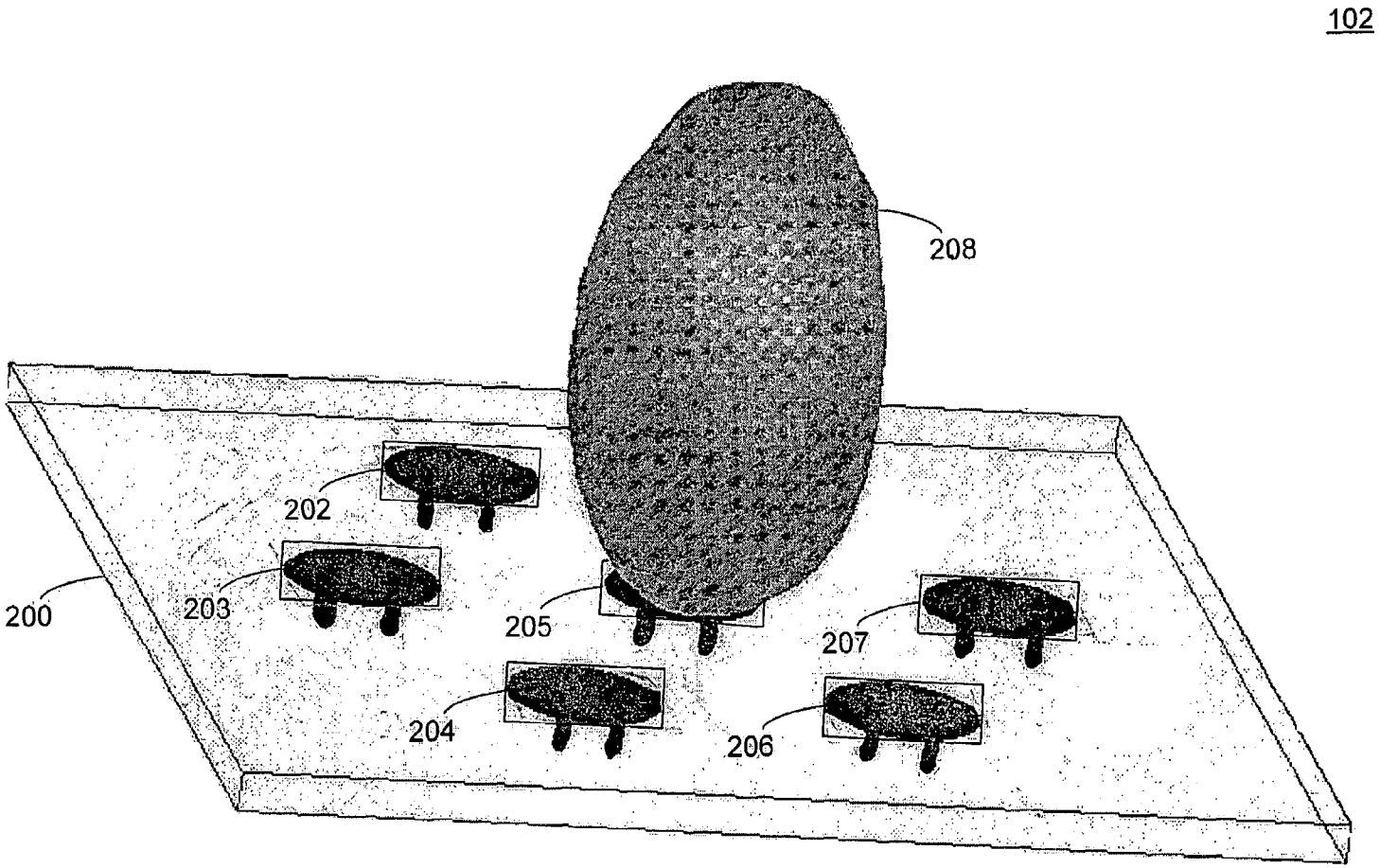
FIG. 2 is a high level illustration of a phased antenna element array that can be used in the implementation of FIG. 1.

FIG. 2 is a high level illustration of the phased array antenna 102 shown in FIG. 1. In FIG. 2, the phased array antenna 102 includes one or more individual antenna arrays, such as an antenna array 200. The antenna array 200 includes conventional micro-strip patch antenna elements 202-207. Each of the conventional patch antenna elements 202-207 radiates a circularly polarized antenna pattern, such as antenna pattern 208.

In the antenna array 200, each of the micro-strip elements 202-207 can be used as a single element within the multi-element array 200. Alternatively, each of the elements 202-207 can be used as a separate, independently radiating antenna. As known in the art, antenna beams produced by the array 200 can be steered by shifting their phase. For example, in the antenna array 200, beams constructively and/or destructively interfere with one another so as to steer a relatively broad combined beam, or individual beams, in a desired direction.

Figure 3:
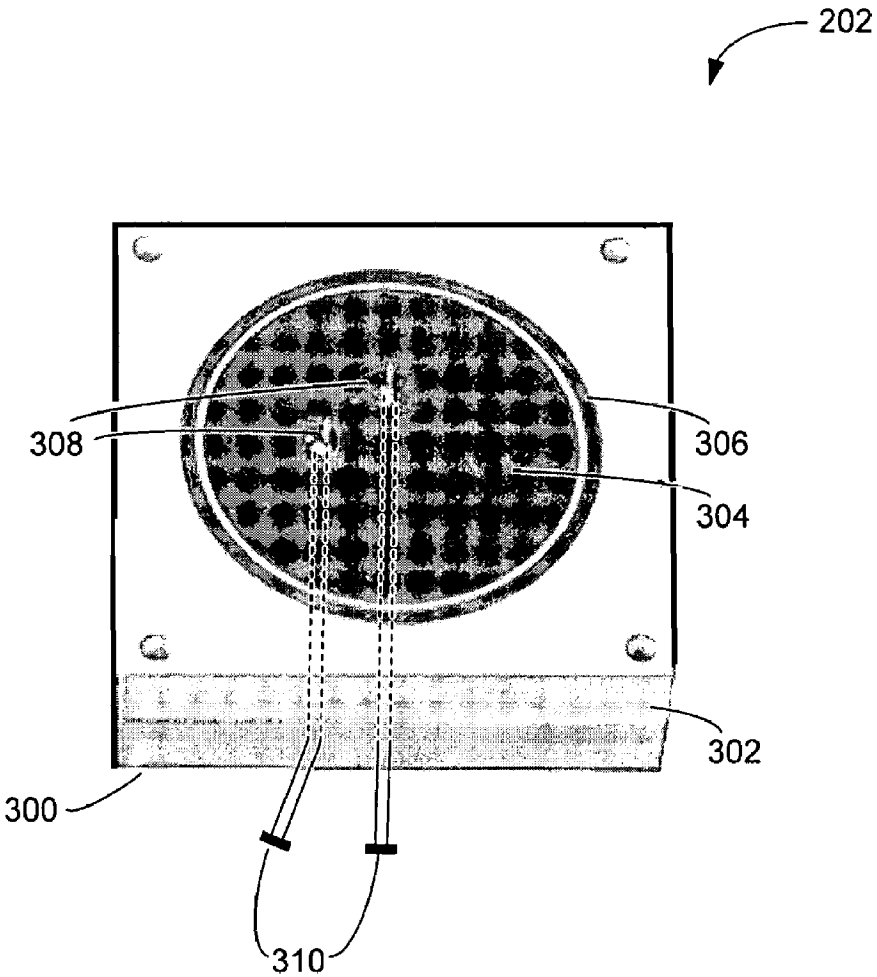
FIG. 3 is an exemplary illustration constructed and arranged in accordance with a first embodiment of the present invention.

FIG. 3 is a more detailed illustration of the exemplary micro-strip element 202 shown in FIG. 2. The micro-strip element 202 is capable of operating in two different frequency bands and includes a metallic conducting ground plane 300, which assists in the suppression of antenna pattern back-lobes. A dielectric material substrate 302 is positioned on or near a surface of the conducting ground plane 300 and is usually a few hundred mils thick.

The dielectric substrate layer 302 has a relatively high dielectric constant. In some designs, the dielectric constant is as high 12.8 to 36, and is used to reduce the size of the microstrip antenna for airborne applications where space available for antenna deployment is generally very limited. The high dielectric constant also broadens the antenna beam allowing the antenna to receive signals from various satellites covering a wide range of elevation angles.

Next, the micro-strip element 202 includes a central patch radiator portion 304 positioned on or near a surface of the dielectric substrate 302. The central patch 304 comprises a radiating patch of any planar geometry (e.g., annular, square, elliptical, and rectangular) on one side of the dielectric substrate 302. The patch 302 can be constructed of any suitable conductive material, such as aluminum or copper.

The conducting ground plane is positioned on the other side of the dielectric substrate 302. The central patch 304 is fed by two orthogonal probes 308, excited with equal amplitudes but with a relative phase difference of 90 degrees to generate the desired type of circular polarization (CP). A parasitic ring radiation portion 306 surrounds the patch 304 and is fundamental to generating the second frequency band. An exemplary thickness of the central patch 304 can be, from about 1 to 2 mils.

As shown in FIG. 3, there is no direct metal contact between the parasitic ring 306 and the central patch portion 304. Instead of a metallic connection, the parasitic ring 306 is reactively coupled to the central patch 304. There is also no direct metal contact between the parasitic ring 306 and either of the orthogonal probes 308.

The present invention does not strictly require the use of two probes for exciting the central patch portion 304, as shown in FIG. 3. Any suitable number of probes can be used. For example, the patch 304 can be fed by a single probe to generate linear polarization (LP).

As noted above, the central patch 304 and the parasitic ring 306 are not limited to any particular shape. Additionally, the ground plane 300 in the dielectric substrate 302 can also include different shapes. In addition two different dielectric substrates, each with different dielectric constants can be used instead of a single dielectric layer 302. The use of two different dielectric layers instead of a single dielectric layer in 302 allows more design options such as varying the width of the antenna beam or controlling the bandwidth. The probes 308 are connected to coaxial cables 310, which extend through the dielectric substrate and the ground plane 300. The cables 310 connect the central patch portion 304 to a transmission line and/or radio (not shown).

The micro-strip element 202 provides a broad antenna beam serving an almost hemispherical coverage area. This enables the antenna to acquire signals from multiple satellites covering a wider range of elevation angles allowing better range position accuracy in GPS navigation systems. Further, the element 202 can be configured as a stand alone antenna (radiator), or can also be used as an element of a multi-element array, such as the array 102, shown in FIG. 2.

In FIG. 3, the central patch 304 and the parasitic ring 306 enable the micro-strip patch antenna 202 to operate within two different frequency bands. For example, the central patch portion 304 operates at a center frequency of about 1.575 GHz and the parasitic ring 304 operates at a center frequency of about 1.227 GHz. Each of the central patch antenna 304 and the parasitic ring 306 has a bandwidth of about 24 MHz and radiates using circular polarization.

As noted above, there is no direct metal connection between the central patch 304 and the parasitic ring 306. As such, the parasitic ring 306 is considered to be reactively coupled to the central patch 304. That is, only the central patch portion receives electrical excitation. The central patch portion 304 receives a signal via the orthogonal probes 308 by way of the coaxial connectors 310. When energized, electromagnetic currents generally flow evenly throughout the central patch portion 304.

Achieving acceptable antenna gain across each of the operational frequency bands is also a desirable characteristic of the micro-strip patch antenna 202 shown in FIG. 3. The gain is a direct function of the surface area of the central patch 304 in which the electromagnetic currents flow. The larger the surface area of the central patch portion 304, the higher the gain. In other words, gain is proportional to the surface area in which the currents are flowing. The surface area, along with, other geometric features of the micro-strip patch antenna 202, will be discussed in greater detail below.

When the central patch 304 is energized via the probes 308, the currents that flow across the central patch 304 electromagnetically couple into the parasitic ring 306. The parasitic ring 306 thereby passively radiates (albeit at a different frequency) the energy that was directly fed into the central patch portion 304 via the probes 308.

The inventors have discovered through experimentation that the direct radiation of the central patch portion 304 and the passive radiation of the parasitic ring 306 both occur at relatively high gain levels and both naturally radiate circularly polarized signals. In the embodiment of FIG. 3, for example, the central patch 304 and the parasitic ring 306 both radiate right hand circularly polarized signals.

In the embodiment of FIG. 3, a distance between the parasitic ring 306 and the central patch 304 is small enough such that fringing electromagnetic fields couple strongly and uniformly across the central patch 304 and the parasitic ring 306. The direct radiation of the central patch 304 produces the band 1 signal. The passive radiation of the parasitic ring 306 produced by the electromagnetic coupling from the central patch 304, produces the band 2 signal, generally the lower of the two frequency bands. The specific frequencies produced by radiation from the central patch 304 and the parasitic ring 306, are determined based upon specific user requirements and are a function of the geometries of the central patch 304 and parasitic ring 306.

For example, if a distance (gap) between the central patch 304 and parasitic ring 306 is too small, the gain and other characteristics of the band 2 signal greatly diminish. Thus, it is desirable that the physical dimensions of the central patch 304 and parasitic ring 306 be carefully controlled and moderated. It is particularly desirable that the diameter of the parasitic ring 306, and its distance from the central patch 304, be carefully determined. These aspects of the present invention will be discussed in additional detail below.

Figure 4:
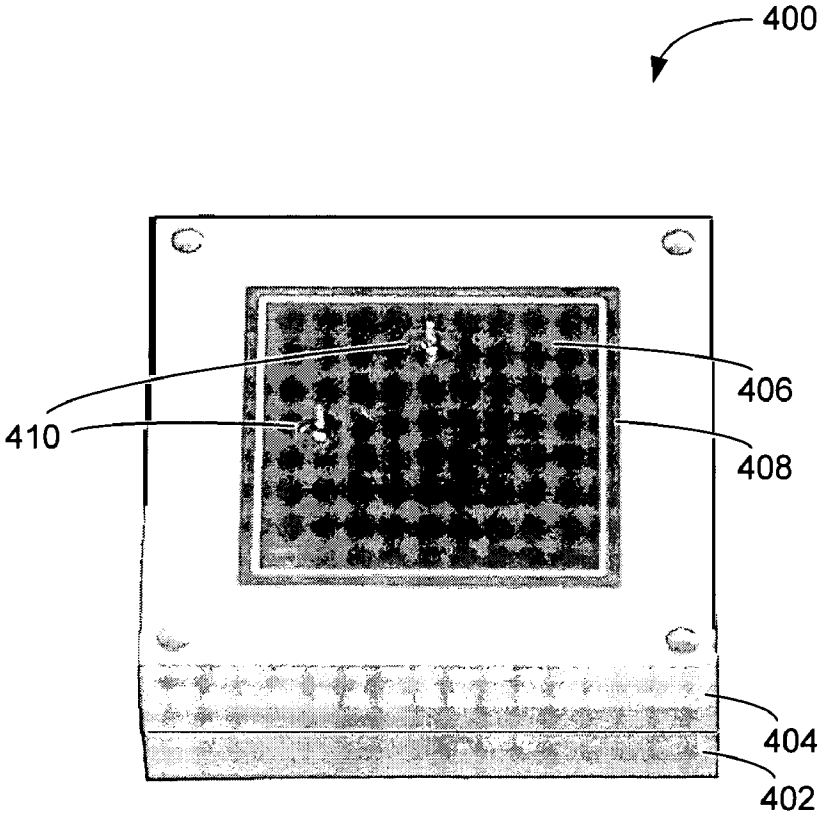
FIG. 4 is an exemplary illustration constructed and arranged in accordance with a second embodiment of the present invention.

FIG. 4 is an illustration of an exemplary micro-strip patch antenna 400 constructed and arranged in accordance with a second embodiment of the present invention. The micro-strip patch antenna 400 of FIG. 4 is substantially square in shape, as opposed to the circular shape of the micro-strip patch element 202 shown in FIG. 3. The function and operation of the micro-strip patch 400 is substantially identical to the function and operation of the micro-strip patch 202. Therefore, these aspects of the micro-strip patch 400 will not be repeated.

The micro-strip patch element 400 includes a conducting ground plane 402 and a dielectric substrate layer 404. In FIG. 4, a substantially square central patch portion 406 is surrounded by a substantially square thin parasitic ring 408. Orthogonal probes 410, extending through the dielectric layer 404 and the conducting ground plane 402, connect to the central patch portion 406. As explained in the discussion of FIG. 3, the central patch 406 does not include a direct metal connection to the parasitic ring 408. Similarly, the parasitic ring 408 does not have a direct metal connection to the probes 410.

The first and second frequency bands produced by the central patch 406 and parasitic ring 408 are about 1.679 GHz and 1.365 GHz, respectively. Each of the first and second frequency band signals has a bandwidth of about 24 MHz. A gain of about 4.28 dB is achieved at the 1.679 GHz band. A gain of about 1.944 dB is achieved at the 1.365 GHz frequency band.

The micro-strip patch element 202 of FIG. 3 and the micro-strip patch element 400 of FIG. 4 can have either right hand circular or left hand circular polarized depending on the relative 90 degree phase difference between the excitation voltages at the two probes connected to each patch antenna; both probes have equal amplitude signals required for generating circular polarization.

In the embodiments of FIGS. 3 and 4, a cross polarization component has been observed that is at least 10 dB smaller than a co-polarized component at the boresight direction. As noted previously, the present invention, however, is not limited to the specific performance characteristics discussed above nor the geometric features discussed below.

Figure 5:
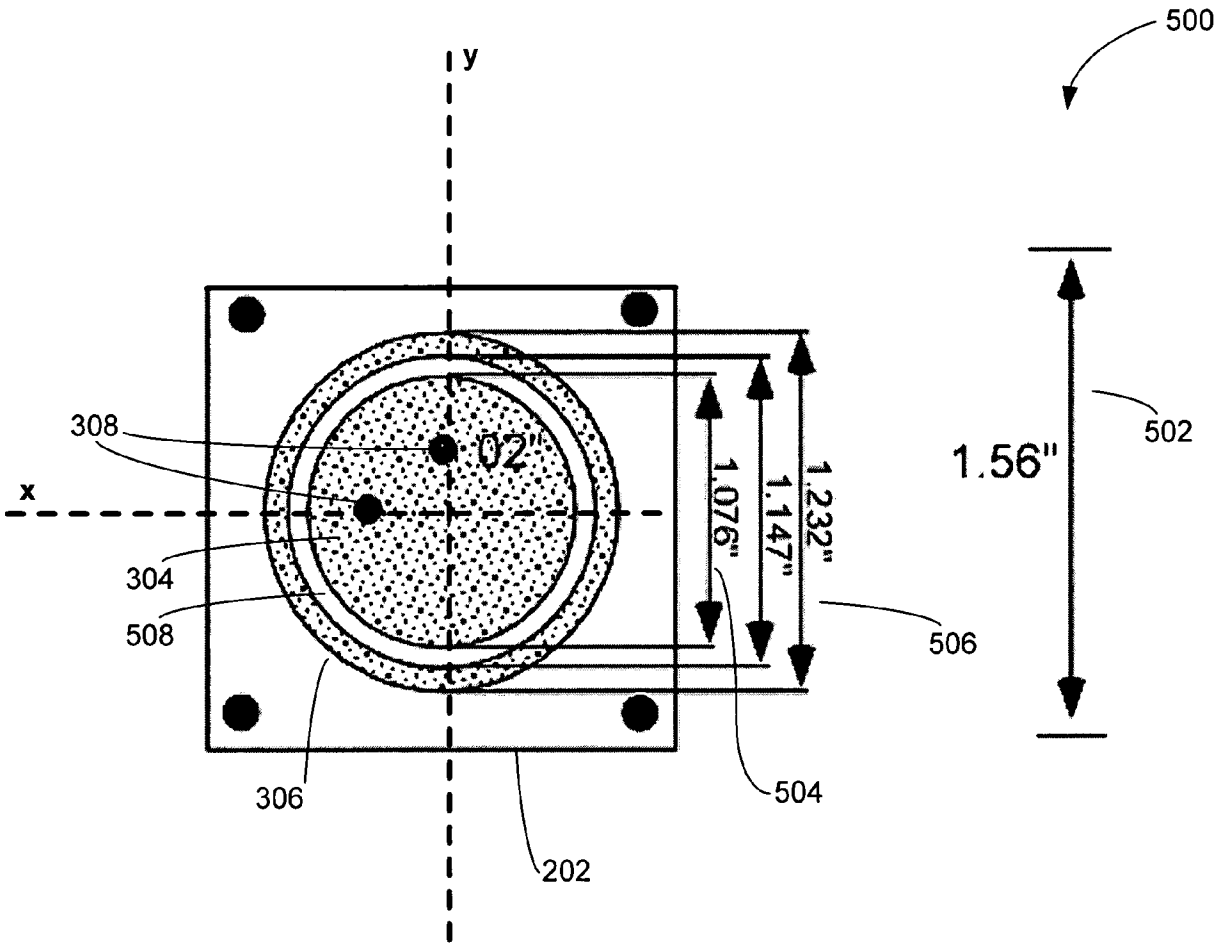
FIG. 5 is a more detailed illustration of the first embodiment shown in FIG. 3.

FIG. 5 is a more detailed illustration of geometric features of the micro-strip patch element 202, shown in FIG. 3. Although specific dimensions are illustrated in FIG. 5, the present invention is not limited by these physical dimensions. The physical dimensions, shown in the illustration of FIG. 5, were chosen to produce the specific performance characteristics discussed above.

The micro-strip patch element 202 operates at the band 1 and the band 2 frequencies. The band 1 signal is produced by the central patch 304 and has a center frequency of about 1.575 GHz and an effective bandwidth of about 24 MHz. The band 2 signal is produced by the parasitic ring 306. The band 2 signal has a center frequency of about 1.227 GHz and a bandwidth of about 24 MHz. The physical dimensions discussed below facilitate the generation of these specific frequency characteristics. Additionally, a gain of about 3.274 dBic (Decibel-Isometric-Circular) for right hand circular polarization is achieved at the 1.575 GHz frequency band. A gain of about 1.897 dBic for right hand polarization is also achieved at the 1.227 GHz frequency band. Generally, for example, a patch diameter is inversely proportional to its frequency.

A length and height measurement 502 of the patch 202 is about 1.56 inches. Next, a diameter 504 of the central patch 304 is about 1.076 inches, while a diameter 506 of the parasitic ring 306 is about 1.232 inches. Exemplary widths of the ring 306 are within a range of about 0.9 to 1.3 inches. An exemplary distance 508, between the central patch 304 and the parasitic ring 306, is within a range of about 0.03 to 0.08 inches.

The diameter 506 and the distance 508 are a function of the diameter 504 of the central patch 304. That is, once the diameter 504 has been selected, based upon a desired band 1 frequency, the diameter 506 and the distance 508 must then be carefully selected. For example, if the distance 508 between the central patch 304 and the parasitic ring 306 is too large, or too small, the proper gain and frequency characteristics of the band 2 frequency cannot be achieved. The inventors empirically determined exemplary values for the diameters 506 and the distance 508, for a range of diameters 504. These empirical determinations were pursued to ensure that acceptable gain and center frequency characteristics can be achieved in any micro-strip patch antenna, based on user selected performance requirements.

As shown in FIG. 5, one of the probes 308 is positioned along a Y axis at a central point between the center of the central patch 304 and a perimeter of the central patch 304, at an exemplary distance of about 0.2 inches. Similarly, another one of the probes 308 is positioned along an X axis at a position about half way between the center and the perimeter of the central patch 304 at an exemplary distance of about 0.2 inches. The optimum location of the probe is selected to allow a good impedance match of the antenna to the receiver (or transmitter) to which it is connected depending on the application.

Figure 6:
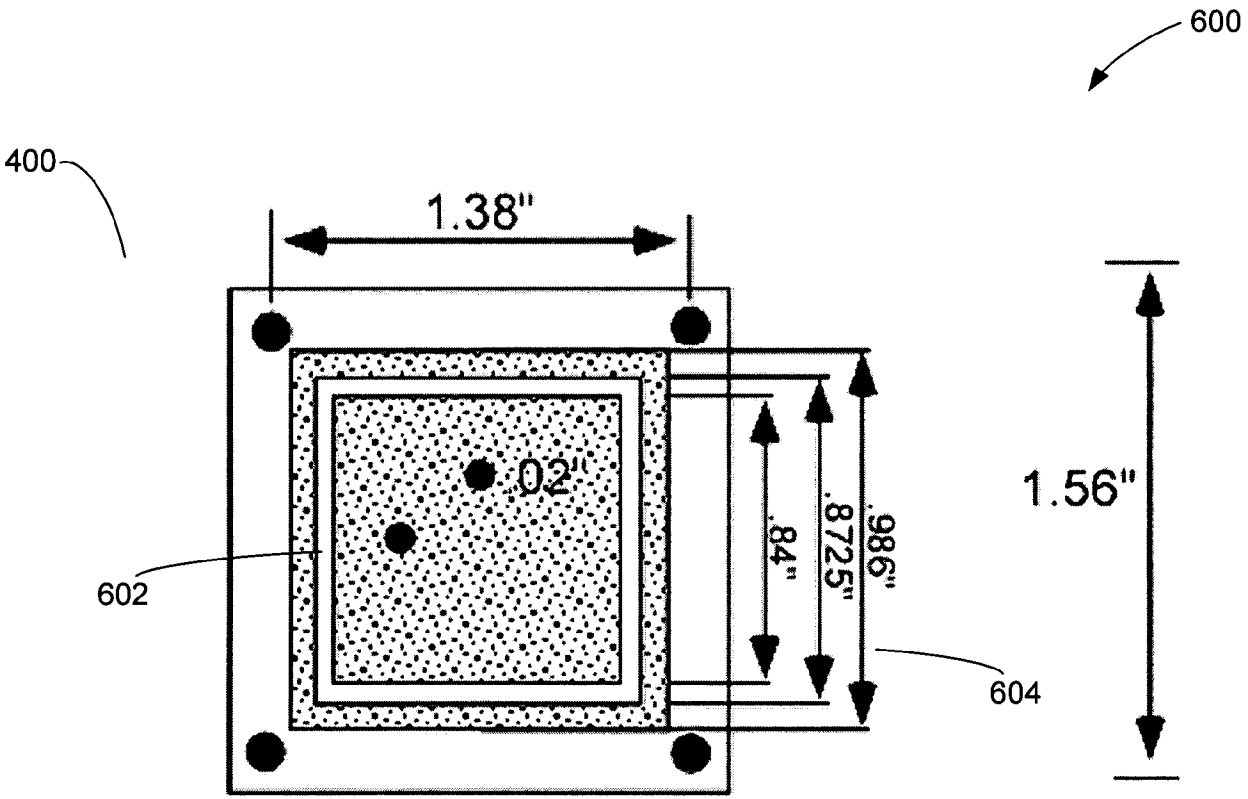
FIG. 6 is a more detailed illustration of the second embodiment shown in FIG. 4.

FIG. 6 is an illustration of surface features 600 of the central patch 400 shown in FIG. 4. Of particular note, a distance 602 between the parasitic ring 408 and the central patch 406 of the micro-strip patch antenna 400 is about 0.0325 inches. An exemplary link/height measurement 604 of the parasitic ring 408 is about 0.986 inches, although other suitable dimensions are possible.

CONCLUSION

The present invention provides a micro-strip patch antenna which is capable operating in two different frequency bands. The antenna provides a broad beam serving a hemispherical coverage. The compact size light weight and low cost to fabrication of the micro-strip patch antenna of the present invention makes it particularly applicable to current navigation, vehicular, wireless communications, and radar systems that require dual frequency and/or wideband operation.

The present invention has been described above with the aid of functional building blocks illustrating the performance of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented, herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What we claim is:

1. An antenna assembly capable of dual frequency band operation, comprising:

a conducting ground plane;

at least one from a group including (i) a single dielectric substrate layer and (i) a plurality of dielectric substrate layers having different dielectric constants, disposed on the conducting ground plane;

a central patch element disposed on the dielectric substrate layer and configured to radiate within a first frequency band;

a plurality of probes (i) extending through the conducting ground plane and the one from the group and (ii) physically connected to the central patch element; and a parasitic ring disposed around the central patch element and reactively coupled thereto, the parasitic ring being (i) devoid of any direct connection to the ground plane and (ii) configured to radiate within a second frequency band;

wherein the central patch element and the parasitic ring are co-planar.

2. The antenna assembly according to claim 1, wherein the parasitic ring is devoid of a direct metal connection to the central patch element.

3. The antenna assembly according to claim 2, wherein the parasitic ring is devoid of a direct metal connection to any of the plurality of probes.

4. The antenna assembly according to claim 1, wherein the central patch element and the parasitic ring produce circularly polarized signals.

5. The antenna assembly according to claim 4, wherein the circularly polarized signals are right hand circularly polarized.

6. The antenna assembly according to claim 1, wherein the probes comprise two orthogonal coaxial probes; and wherein each of the two coaxial probes is configured for electrical excitation from respective signals substantially equal in amplitude and having a phase difference of about 90 degrees.

7. The antenna assembly according to claim 1, wherein the first and second frequency bands have bandwidths within a range of about 20 to 24 megahertz (MHz).

8. The antenna assembly according to claim 1, wherein a shape of the central patch element is at least one of circular, elliptical, square, triangular and rectangular.

9. The antenna assembly according to claim 1, wherein the central patch element is substantially square.

10. The antenna assembly according to claim 1, wherein the probes are coaxial.

11. The antenna assembly according to claim 1, wherein the parasitic ring is devoid of direct excitation.

12. The antenna assembly according to claim 11, wherein the parasitic ring is configured to (i) receive energy radiated from the central patch element and (ii) re-radiate the received energy.

13. The antenna assembly according to claim 12, wherein the first frequency band includes frequencies within a range of about 1.5 to 1.6 gigahertz (GHz);

wherein the second frequency band is based upon the re-radiated received energy; and wherein the re-radiated received energy is within a range from about 1.2 to 1.3 GHz.

14. The antenna assembly according to claim 13, wherein the width of the parasitic ring is within a range of about 0.9 to 1.3 inches.

15. The antenna assembly according to claim 14, wherein the distance between the central patch element and the parasitic ring is within a range of about 0.03 to 0.08 inches.

16. A micro-strip patch antenna, comprising:

a central patch element disposed on a base portion having a ground plane and configured to radiate within a first frequency band;

a plurality of probes (i) extending through the base portion and (ii) physically connected to the central patch element; and a parasitic ring disposed about the central patch element and reactively coupled thereto, the parasitic ring being (i) devoid of any direct connection to the ground plane and (ii) configured to radiate within a second frequency band;

wherein the central patch element and the parasitic ring are co-planar.

17. The micro-strip patch antenna according to claim 16, wherein the parasitic ring is devoid of a direct metal connection to the central patch element and is devoid of a direct metal connection to any of the plurality of probes.

18. A micro-strip patch antenna, comprising:

a substantially annular central patch element disposed on a base portion having a ground plane and configured to radiate within a first frequency band;

a plurality of probes (i) extending through the base portion and (ii) physically connected to the central patch element; and a substantially annular parasitic ring disposed about the central patch element and reactively coupled thereto, the parasitic ring being (i) devoid of any direct connection to the ground plane and (ii) configured to radiate within a second frequency band;

wherein the parasitic ring is devoid of a direct metal connection to the central patch element and to any of the number of probes;

wherein a width of the central patch antenna element is within a range of about 0.8 to 1.1 inches;

wherein a distance between the central patch element and the parasitic ring is within a range of about 0.03 to 0.08 inches;

wherein a width of the parasitic ring is within a range of about 0.9 to 1.3 inches; and wherein the central patch element and the parasitic ring are co-planar.

* * * * *